US007552513B2

(12) United States Patent
Cheng

(10) Patent No.: US 7,552,513 B2
(45) Date of Patent: Jun. 30, 2009

(54) BARRIER HINGE ASSEMBLY

(76) Inventor: Shu-Chen Cheng, 10F, No. 29-5, Sec. 2, Chung Cheng E. Rd., Tamshui Chen, Taipei Hsien (TW)

( * ) Notice: Subject to any disclaimer, the term of this patent is extended or adjusted under 35 U.S.C. 154(b) by 33 days.

(21) Appl. No.: 11/898,736

(22) Filed: Sep. 14, 2007

(65) Prior Publication Data

US 2009/0070965 A1 Mar. 19, 2009

(51) Int. Cl.
*E05D 11/10* (2006.01)

(52) U.S. Cl. ..... 16/334; 16/264

(58) Field of Classification Search ..... 16/338–340, 16/381, 300, 264, 334; 160/135, 351; 256/26, 256/73

See application file for complete search history.

(56) References Cited

U.S. PATENT DOCUMENTS 4,583,262 A * 4/1986 Werner ..... 16/300
5,771,505 A * 6/1998 Reynolds ..... 4/559
7,096,536 B2 * 8/2006 Johnson ..... 16/300
7,197,791 B1 * 4/2007 Smith ..... 16/375

FOREIGN PATENT DOCUMENTS

GB 2299120 A * 9/1996

* cited by examiner

*Primary Examiner*—William L. Miller
(74) *Attorney, Agent, or Firm*—Muncy, Geissler, Olds & Lowe, PLLC

(57) ABSTRACT

A barrier hinge assembly has an upper hinge assembly, a lower hinge assembly and a turnbuckle assembly. The upper hinge assembly has an upper pintle device and an upper gudgeon device. The upper pintle device has a pintle protruding down. The upper gudgeon device has a through hole in which the upper pintle is mounted. The lower hinge assembly has a lower gudgeon device and a lower pintle device. The lower gudgeon device has a through hole. The lower pintle device has a pintle protruding up and mounted through the through hole of the lower gudgeon device. The turnbuckle assembly is fastened to the pintles of the upper and the lower pintle devices at the same time to hold the upper and the lower gudgeon devices in specific positions.

12 Claims, 5 Drawing Sheets

BARRIER HINGE ASSEMBLY

BACKGROUND OF THE INVENTION

1. Field of the Invention

The present invention relates to a barrier hinge assembly, especially to a barrier hinge assembly that can be folded and unfolded firmly and adjusted easily.

2. Description of the Prior Art

Barriers can be placed around hazardous or dangerous objects to prevent people from contacting the objects, across passageways to block access to a specific area or around children or pets to restrict their movement to a given area to keep them from being harmed.

With reference to FIG. 5, a conventional barrier comprises two or more barrier segments (AA) connected by a conventional barrier hinge assembly. The conventional barrier hinge assembly is mounted on protruding ends of adjacent barrier segments (AA) and comprises an upper hinge assembly (60), a lower hinge assembly (70) and a pivot assembly (80).

The upper hinge assembly (60) is mounted on upper ends of adjacent barrier segments (AA) and has an upper gudgeon device (61) and an upper pintle device (62). The upper gudgeon device (61) is attached to and protrudes longitudinally from the upper end of one barrier segment (AA) and has a lower surface and a cylindrical protrusion. The cylindrical protrusion is formed on and protrudes down from the lower surface and has a central pivot hole, an outer edge and multiple teeth (611). The teeth (611) are formed longitudinally on the outer edge of the cylindrical protrusion. The upper pintle device (62) is attached to and protrudes longitudinally from an upper end of the other adjacent barrier segment (AA), engages and holds the upper gudgeon device (61) and has an upper surface, a lower surface, a recess (621), an upper pintle, multiple teeth (622) and a coaxial recess (623). The recess (621) is formed in the upper surface of the upper pintle device (62) and has an inner sidewall. The upper pintle is formed concentrically in and protrudes up from the recess (621) and is mounted rotatably in the central pivot hole in the upper gudgeon device (61). The teeth (622) are formed longitudinally in the inner sidewall of the recess (621) and correspond to and selectively engage the teeth (611) on the cylindrical protrusion of the upper gudgeon device (61) to hold the upper gudgeon device (61) in place. The coaxial recess (623) is formed in the lower surface of the upper pintle device (62) concentrically with the recess (621).

The lower hinge assembly (70) is mounted on lower ends of adjacent barrier segments (AA) and has a lower gudgeon device (71) and a lower pintle device (72). The lower gudgeon device (71) is attached to and protrudes longitudinally from the lower end of one barrier segment (AA) and has a lower surface, a cylindrical protrusion and a through hole (712). The cylindrical protrusion is formed on and protrudes down from the lower surface and has an outer edge and multiple teeth (711) The teeth (711) are formed longitudinally on the outer edge of the cylindrical protrusion. The through hole (712) is formed concentrically through the lower gudgeon device (71) and the cylindrical protrusion. The lower pintle device (72) is attached to and protrudes longitudinally from the lower end of the other adjacent barrier segment (AA), engages and holds the lower gudgeon device (71) and has an upper surface, a recess (721), a lower pintle and multiple teeth (722). The recess (721) is formed in the upper surface of the lower pintle device (72) and has an inner sidewall. The lower pintle is formed concentrically in and protrudes up from the recess (721) and is mounted rotatably in the central through hole (712) in the lower gudgeon device (71). The teeth (722) are formed longitudinally the inner sidewall of the recess (721) and correspond to and selectively engage the teeth (711) of the lower gudgeon device (71) to hold the lower gudgeon device (71) in place. The pivot assembly (80) is mounted between the upper and the lower hinge assemblies (60, 70) and has a spring (81) and a pivot rod (82). The spring (81) is mounted in the coaxial recess (623) of the upper pintle device (62). The pivot rod (82) is mounted in the coaxial recess (623) of the upper pintle device (62) against the spring (81) and through the through hole (712) of the lower gudgeon device (71) against the lower pintle of the lower pintle device (72).

To adjust the conventional barrier, one barrier segment (AA) is lifted axially along the pivot assembly (80) until the teeth (611, 711) of the upper and lower gudgeon devices (61, 71) disengage from the teeth (622, 722) of the upper and lower pintle devices (62, 72). Then, adjacent barrier segments (AA) can be pivoted relative to each other to fold or unfold the barrier.

However, the conventional barrier hinge assembly is held in position merely with the teeth (611, 711) of the upper and lower gudgeon devices (61, 71) engaging the teeth (622, 722) of upper and lower pintle devices (62, 72). Bumping or lifting one barrier segment (AA) easily disconnects adjacent barrier segments (AA). Furthermore, lifting one barrier segment (AA) only enough to disengage the teeth (611, 621, 712, 722) and not to disconnect the barrier segments (AA) is inconvenient to operate. Also, the teeth (611, 621, 712, 722) break easily improperly aligned or wear down with long-term use. Moreover, the spring (81) that pushes the upper pintle device (62) to engage the upper gudgeon device (61) and the pivot rod (82) mounted in the through hole (712) of the lower gudgeon device (71) cannot hold the barrier segments (AA) firmly in position. Thus, the conventional barrier hinge assembly loosens or collapses easily.

To overcome the shortcomings, the present invention provides a barrier hinge assembly to mitigate or obviate the aforementioned problems.

SUMMARY OF THE INVENTION

The main objective of the present invention is to provide a barrier hinge assembly that operates easily and securely holds adjacent barrier segments together.

The barrier hinge assembly in accordance with the present invention comprises an upper hinge assembly, a lower hinge assembly and a turnbuckle assembly. The upper hinge assembly has an upper pintle device and an upper gudgeon device. The upper pintle device has a pintle protruding down. The upper gudgeon device has a through hole in which the upper pintle is mounted. The lower hinge assembly has a lower gudgeon device and a lower pintle device. The lower gudgeon device has a through hole. The lower pintle device has a pintle protruding up and mounted through the through hole of the lower gudgeon device. The turnbuckle assembly is fastened to the pintles of the upper and the lower pintle devices at the same time to hold the upper and the lower gudgeon devices in specific positions.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
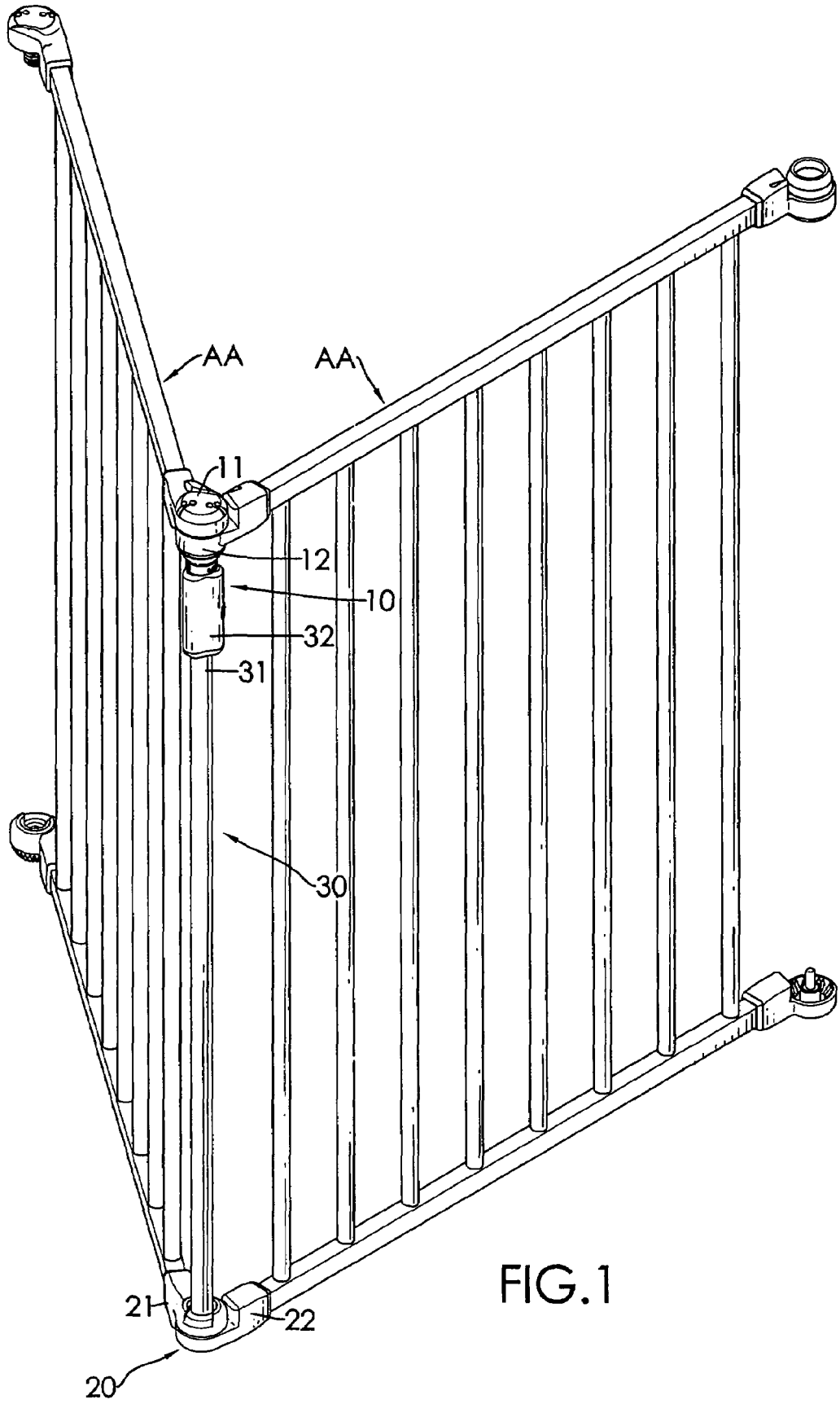
FIG. 1 is an operational perspective view of a barrier with a barrier hinge assembly in accordance with the present invention.
Figure 4:
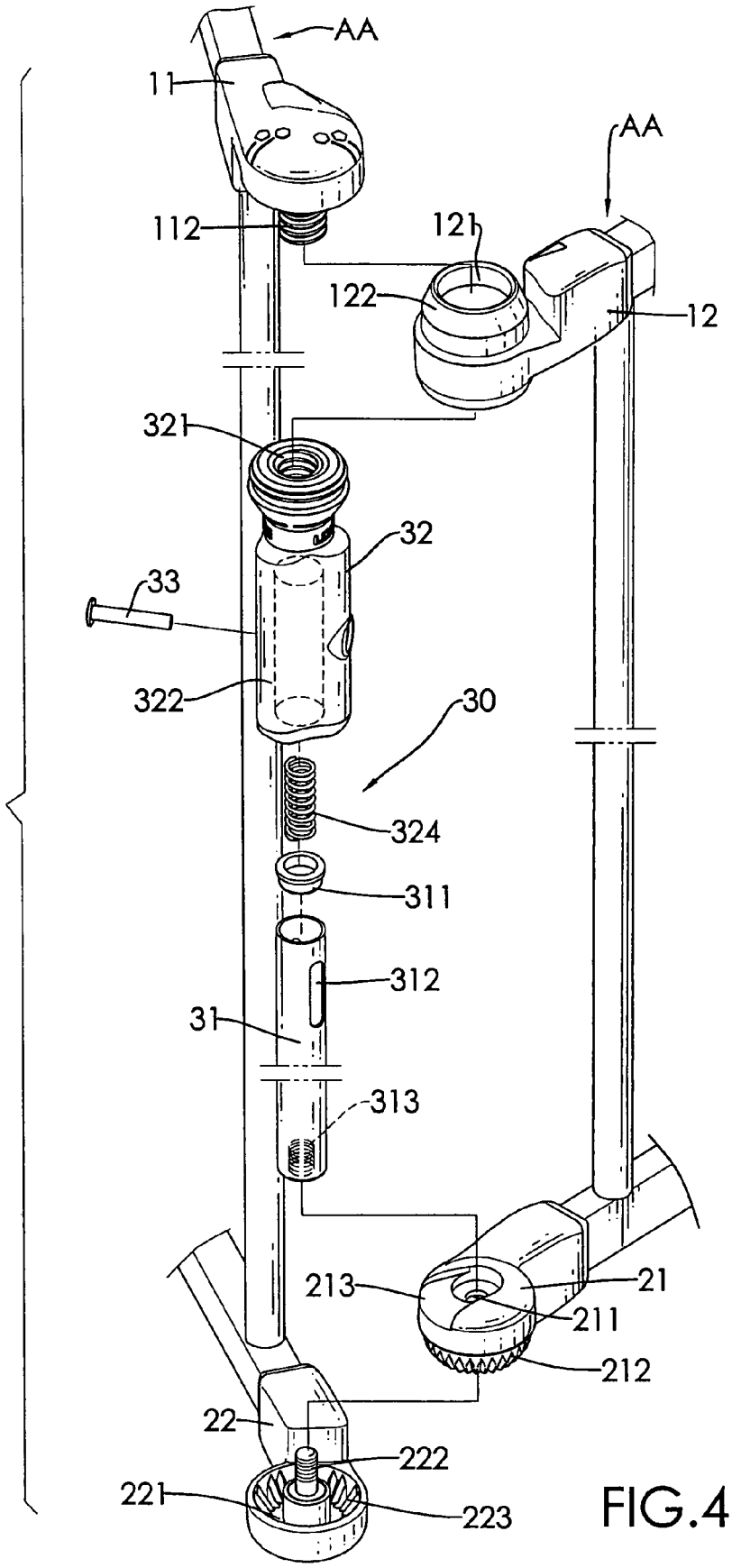
FIG. 4 is an exploded perspective view of the barrier hinge assembly in FIG. 1 connected to adjacent barrier segments with a different arrangement.
Figure 5:
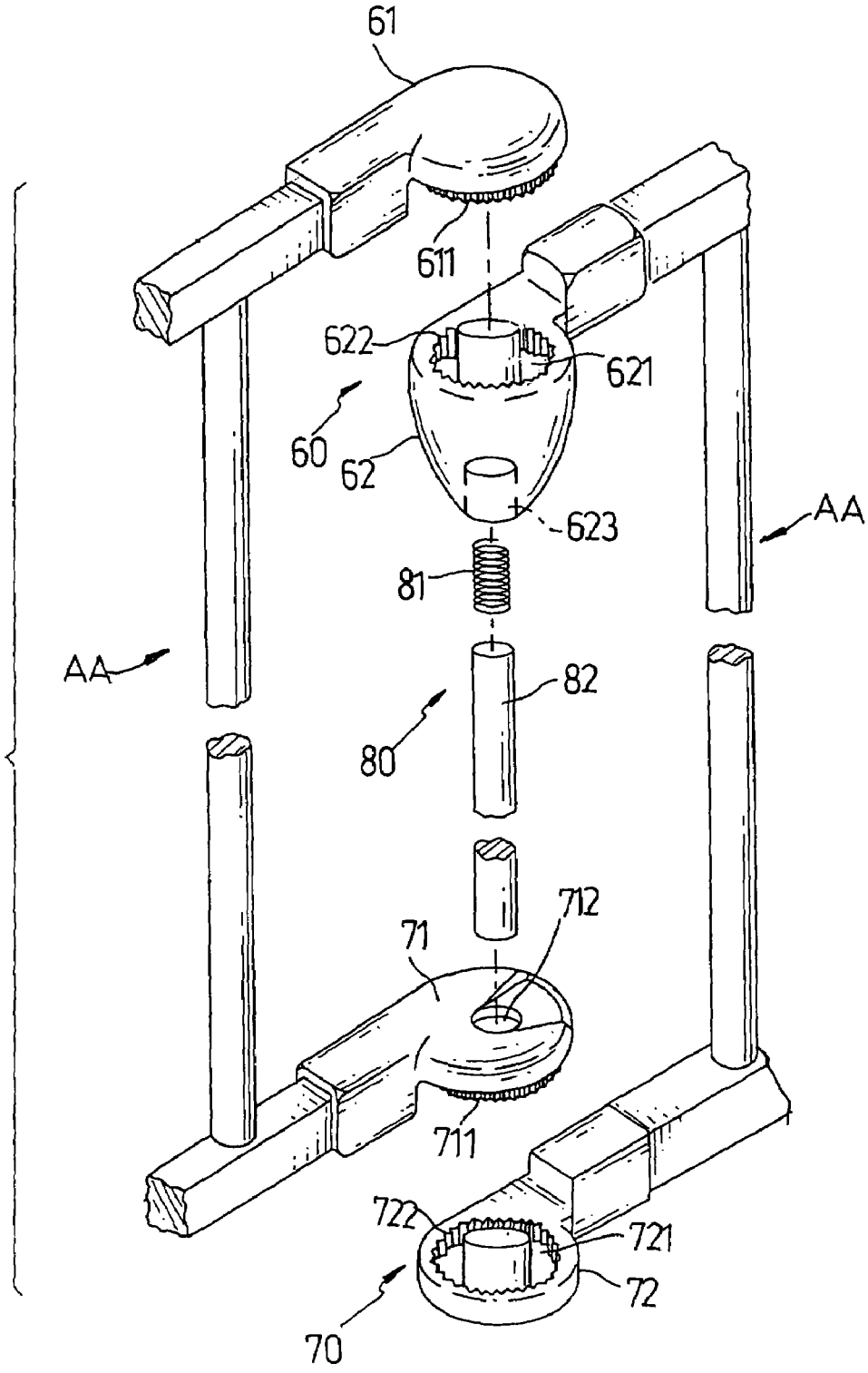
FIG. 5 PRIOR ART
FIG. 5 is an exploded perspective view of a conventional barrier in accordance with the prior art.

With reference to FIGS. 1 and 4, a barrier hinge assembly in accordance with the present invention is mounted between adjacent barrier segments (AA) to allow a barrier so formed to be selectively adjustable and foldable or to be locked in position. The barrier hinge assembly is mounted on protruding ends of adjacent barrier segments (AA) and comprises an upper hinge assembly (10), a lower hinge assembly (20) and a turnbuckle assembly (30).

The upper hinge assembly (10) is mounted on upper ends of adjacent barrier segments (AA) and has an upper pintle device (11) and an upper gudgeon device (12).

Figure 2:
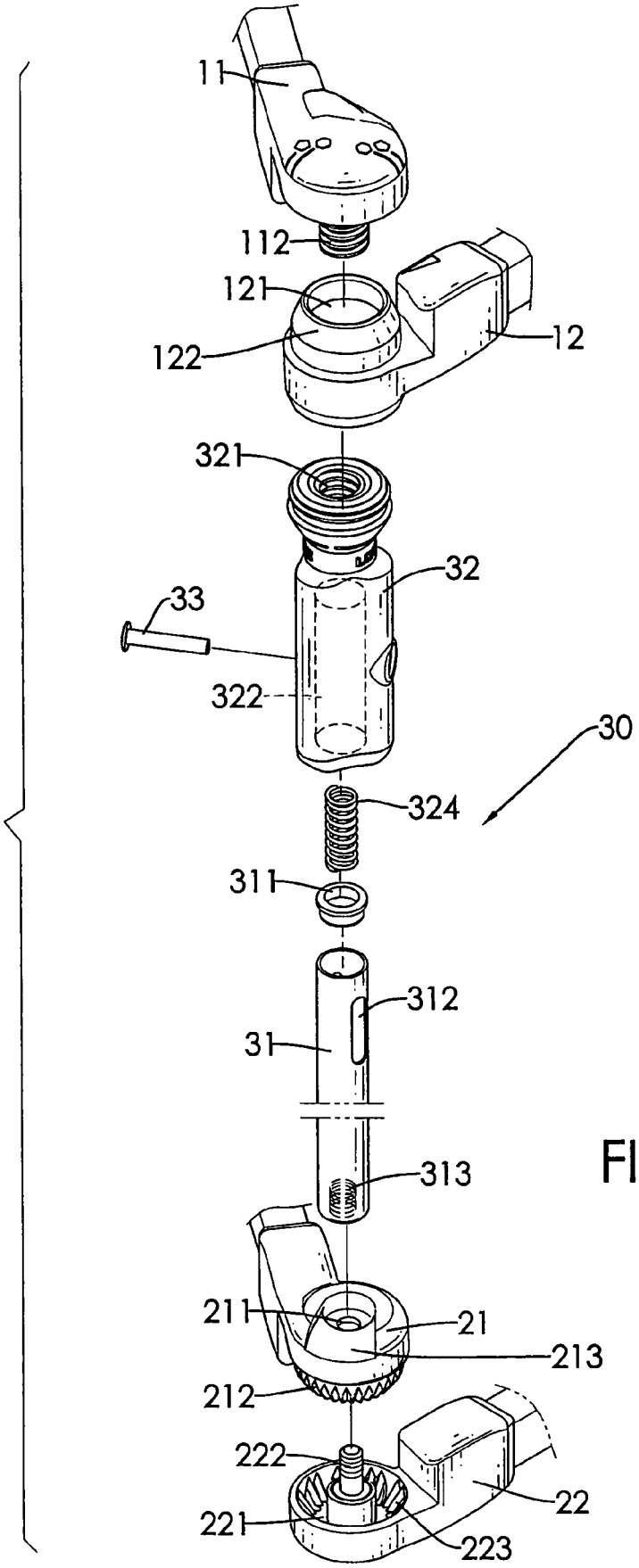
FIG. 2 is an exploded perspective view of the barrier hinge assembly in FIG. 1.
Figure 3:
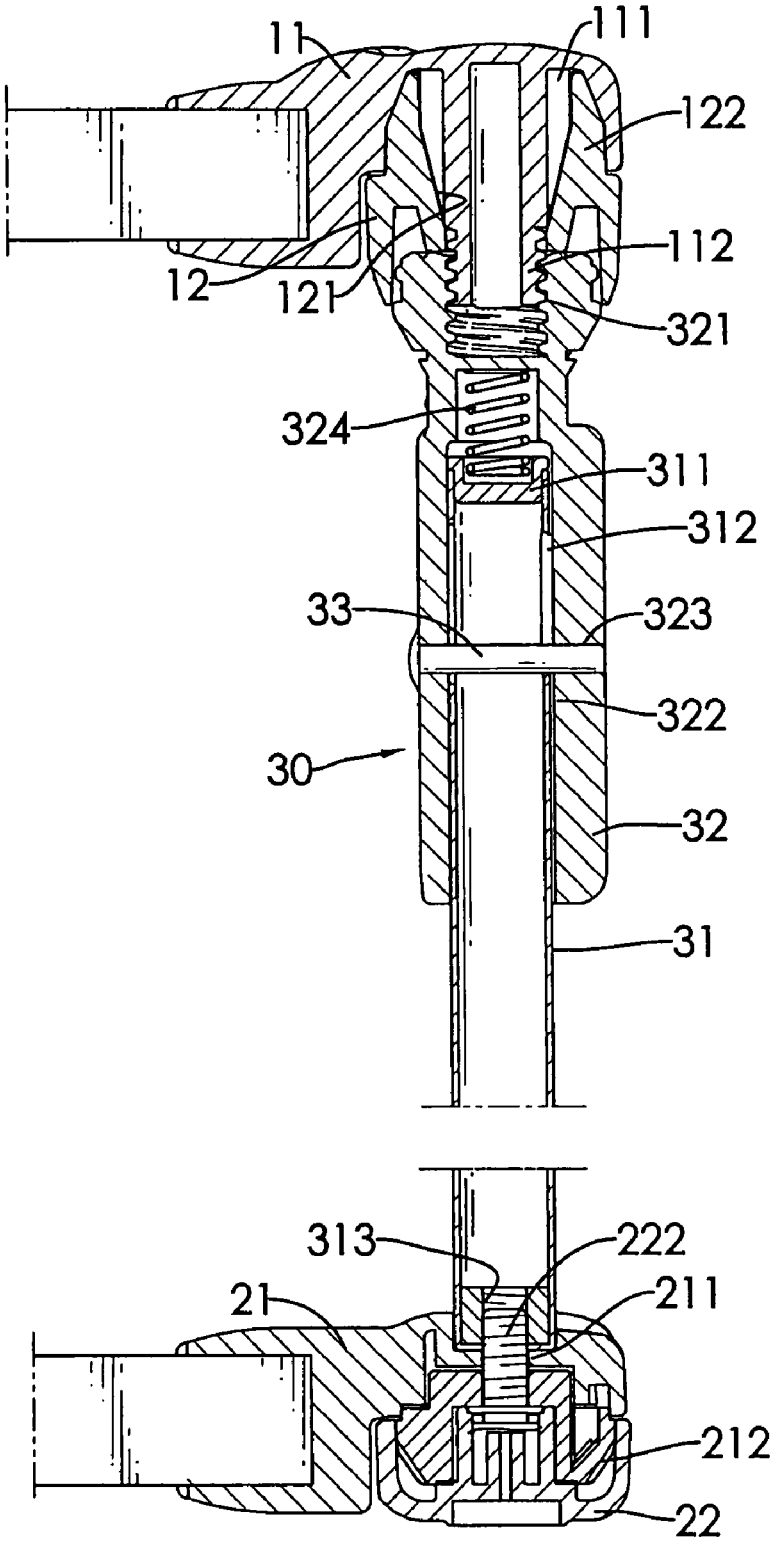
FIG. 3 is a cross-sectional side view of the barrier hinge assembly in FIG. 1.

With further reference to FIGS. 2 and 3, the upper pintle device (11) is attached to and protrudes longitudinally from the upper end of one barrier segment (AA) and has a lower surface, an optional recess (111) and an upper pintle (112). The recess (111) is formed in the lower surface of the upper pintle device (11). The upper pintle (112) is formed on and protrudes down from the lower surface of the upper pintle device (11) concentrically in the recess (111) and has an external thread.

The upper gudgeon device (12) is attached to and protrudes longitudinally from an upper end of the other adjacent barrier segment (AA), is mounted around the upper pintle (112) of the upper pintle device (11), selectively abuts the lower surface of the upper pintle device (11) and has an upper surface, a lower surface, an optional cylindrical protrusion (122) and a through hole (121). The upper surface abuts the lower surface of the upper pintle device (11). The cylindrical protrusion (122) is formed on and protrudes up from the upper surface of the upper gudgeon device (12) and is mounted in the recess (111) of the upper pintle device (11). The through hole (121) is formed through the upper gudgeon device (12) concentrically with the cylindrical protrusion (122) and is mounted rotatably around the upper pintle (112).

The lower hinge assembly (20) is mounted on lower ends of adjacent barrier segments (AA) and has a lower gudgeon device (21) and a lower pintle device (22).

The lower gudgeon device (21) is attached to and protrudes longitudinally from the lower end of one barrier segment (AA) and has an upper surface, a lower surface, a through hole (211), an optional guiding groove (213), an optional cylindrical protrusion and multiple optional teeth (212). The through hole (211) is formed through the lower gudgeon device (21) and has an inner wall. The inner wall may have an annular shoulder. The annular shoulder corresponds to the upper surface of the lower gudgeon device (21). The guiding groove (213) is formed in the upper surface of the lower gudgeon device (21) and communicates with the through hole (211) of the lower gudgeon device (21). The cylindrical protrusion is formed on and protrudes down from the lower surface of the lower gudgeon device (21) around the through hole (211), is tapered and has an outer surface. The teeth (212) are formed longitudinally on the outer surface of the cylindrical protrusion of the lower gudgeon device (21).

The lower pintle device (22) is attached to and protrudes longitudinally from the lower end of the other adjacent barrier segment (AA), selectively engages and holds the lower gudgeon device (21) and has an upper surface, an optional recess (221) and a lower pintle (222). The upper surface of the lower pintle device (22) faces and selectively abuts the lower surface of the lower gudgeon device (21). The recess (221) is formed in the upper surface of the lower pintle device (22), is mounted around the cylindrical protrusion of the lower gudgeon device (21) and has an inner sidewall. The inner sidewall of the recess (221) is tapered, selectively holds and presses against the cylindrical protrusion of the lower gudgeon device (21) and may have multiple teeth (223). The teeth (223) selectively engage the teeth (212) of the cylindrical protrusion of the lower gudgeon device (21) to hold the lower gudgeon device (21) and the lower pintle device (22) in position relative to each other. The lower pintle (222) is formed on and protrudes up from the upper surface of the lower pintle device (22) concentrically in the recess (221), is mounted rotatably through the through hole (211) of the lower gudgeon device (21), is aligned with and faces the upper pintle (112) of the upper pintle device (11) and may have an external thread.

The turnbuckle assembly (30) is connected rotatably to the upper and the lower pintle devices (11, 22), selectively squeezes the upper and the lower gudgeon device (12, 21) between the upper and the lower pintle devices (11, 22) and releases the upper and the lower pintle devices (11, 22) depending on which direction the turnbuckle assembly (30) is turned, has an upper end and a lower end, may be implemented with a main tube (31), a connecting tube (32) and a pin (33) and may have an upper threaded hole (321) and a lower hole (313).

The upper end of the turnbuckle assembly (30) attaches to the upper pintle (112) and abuts the lower surface of the upper gudgeon device (12).

The lower end of the turnbuckle assembly (30) slides through the guiding groove (213), attaches to the lower pintle (222) and abuts the upper surface of the lower gudgeon device (21).

The main tube (31) has an upper open end, a lower open end, a sidewall, a sleeve (311) and two elongated slots (312). The lower open end slides along the guiding groove (213) into the through hole (211) in the lower gudgeon device (21), abuts the upper surface of the lower gudgeon device (21), is mounted around the lower pintle (222) of the lower pintle device (22) and may abut the annular shoulder of the inner wall of the through hole (211) of the lower gudgeon device (21). The sleeve (311) is mounted in the upper open end of the main tube (31). The elongated slots (312) are formed longitudinally through the sidewall of the main tube (31) near the upper open end diametrically opposite to each other.

The connecting tube (32) may be non-circular to allow the turnbuckle assembly (30) to be turned easily and has an upper end, a lower end, a sidewall, a coaxial recess (322), two pinholes (323) and a spring (324). The upper end of the connecting tube (32) abuts the lower surface of the upper gudgeon device (12). The coaxial recess (322) is formed in the lower end of the connecting tube (32) and is mounted around the upper open end of the main tube (31). The pinholes (323) are formed through the sidewall of the connecting tube (32) diametrically opposite to each other and communicate with the coaxial recess (322). The spring (324) is mounted in the coaxial recess (322) and abuts the connecting tube (32) and the sleeve (311).

The upper threaded hole (321) may be formed coaxially in the upper end of the turnbuckle assembly (30), may be formed coaxially in the upper end of the connecting tube (32) of the turnbuckle assembly (30) and corresponds and is fastened to the externally threaded upper pintle (112) of the upperpintle device (11).

The lower hole (313) may be formed coaxially in the lower end of the turnbuckle assembly (30) may be formed coaxially in the lower open end of the main tube (31) of the turnbuckle assembly (30), may be threaded and corresponds and may be fastened to the externally threaded lower pintle (222) of the lower pintle device (22).

The pin (33) extends through the elongated slots (312) of the main tube (31) and the pinholes (323) of the connecting tube (32) to allow the pin (33) and the connecting tube (32) to move axially along the elongated slots (312) of the main tube (31) but not rotate around the main tube (31).

The barrier hinge assembly as described has the following advantages. The upper pintle (112) of the upper pintle device (11) and the lower pintle (222) of the lower pintle device (22) point toward each other. Thus, when the connecting tube (32) is turned, the upper threaded hole (321) of the turnbuckle assembly (30) and the lower threaded hole (313) of the main tube (31) screw onto the upper pintle (112) of the upper pintle device (11) and the lower pintle of the lower pintle device (22) at the same time. Therefore, the upper gudgeon device (12) is held firmly between the upper pintle device (11) and the upper end of the turnbuckle assembly (30) and the lower gudgeon device (21) is held firmly between the lower pintle device (22) and the lower end of the turnbuckle assembly (30). The adjacent barrier segments (AA) are held in specific positions. On the other hand, when the turnbuckle assembly (30) turned in the opposite direction, the upper and the lower threaded holes (321, 313) are loosened respectively from the pintles (112, 222) of the upper pintle device (11) and the lower pintle device (22), adjacent barrier segments (AA) can be adjusted without having the barrier segments (AA) detach from each other.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A barrier hinge assembly comprising an upper hinge assembly having an upper pintle device having a lower surface; and an upper pintle being formed on and protruding down from the lower surface of the upper pintle device and having an external thread; and an upper gudgeon device being mounted around the upper pintle of the upper pintle device, selectively abutting the lower surface of the upper pintle device and having an upper surface abutting the lower surface of the upper pintle device;

a lower surface; and a through hole being formed through the upper gudgeon device and being mounted rotatably around the upper pintle;

a lower hinge assembly having a lower gudgeon device having an upper surface;

a lower surface; and a through hole being formed through the lower gudgeon device and having an inner wall; and a lower pintle device selectively engaging and holding the lower gudgeon device and having an upper surface facing and selectively abutting the lower surface of the lower gudgeon device; and a lower pintle being formed on and protruding up from the upper surface of the lower pintle device, being mounted rotatably through the through hole of the lower gudgeon device and being aligned with and facing the upper pintle of the upper pintle device; and a turnbuckle assembly being connected rotatably to the upper and the lower pintle devices, selectively squeezing the upper and the lower gudgeon devices between the upper and the lower pintle devices and releasing the upper and the lower pintle devices depending on which direction the turnbuckle assembly is turned and having a main tube having an upper open end;

a lower open end abutting the upper surface of the lower gudgeon device and being mounted around the lower pintle of the lower pintle device;

a sidewall;

a sleeve being mounted in the upper open end of the main tube; and two elongated slots being formed longitudinally through the sidewall of the main tube near the upper open end diametrically opposite to each other;

a connecting tube having an upper end abutting the lower surface of the upper gudgeon device;

a lower end;

a sidewall;

a coaxial recess being formed in the lower end of the connecting tube and being mounted around the upper open end of the main tube;

two pinholes being formed through the sidewall of the connecting tube diametrically opposite to each other and communicating with the coaxial recess; and a spring being mounted in the coaxial recess and abutting the connecting tube and the sleeve;

a pin extending through the elongated slots of the main tube and the pinholes of the connecting tube; and an upper threaded hole being formed coaxially in the upper end of the connecting tube of the turnbuckle assembly and corresponding and being fastened to the externally threaded upper pintle of the upper pintle device.

2. The barrier hinge assembly as claimed in claim 1, wherein the lower pintle of the lower pintle device further has an external thread; and the turnbuckle assembly further has a lower hole being formed coaxially in the lower open end of the main tube of the turnbuckle assembly, being threaded and corresponding and being fastened to the externally threaded lower pintle of the lower pintle device.

3. The barrier hinge assembly as claimed in claim 2, wherein the upper pintle device further has a recess being formed in the lower surface of the upper pintle device;

the upper pintle of the upper pintle device is formed concentrically in the recess;

the upper gudgeon device further has a cylindrical protrusion being formed on and protruding up from the upper surface of the upper gudgeon device and being mounted in the recess of the upper pintle device;

the through hole of the upper gudgeon device is formed concentrically with the cylindrical protrusion;

the lower gudgeon device further has a cylindrical protrusion being formed on and protruding down from the lower surface of the lower gudgeon device around the through hole, being tapered and having an outer surface;

the lower pintle device further has a recess being formed in the upper surface of the lower pintle device, being mounted around the cylindrical protrusion of the lower gudgeon device and having an inner sidewall being tapered and selectively holding and pressing against the cylindrical protrusion of the lower gudgeon device; and the lower pintle of the lower pintle device is formed concentrically in the recess of the lower pintle device.

4. The barrier hinge assembly as claimed in claim 3, wherein the lower gudgeon device further has multiple teeth being formed longitudinally on the outer surface of the cylindrical protrusion of the lower gudgeon device; and the inner sidewall of the recess of the lower pintle device further has multiple teeth selectively engaging the teeth of the cylindrical protrusion of the lower gudgeon device.

5. The barrier hinge assembly as claimed in claim 4, wherein the lower gudgeon device further has a guiding groove being formed in the upper surface of the lower gudgeon device and communicating with the through hole;

the inner wall of the through hole of the lower gudgeon device further has an annular shoulder corresponding to the upper surface of the lower gudgeon device; and the lower open end of the main tube of the turnbuckle assembly sliding along the guiding groove into the through hole in the lower gudgeon device and abutting the annular shoulder of the inner wall of the through hole of the lower gudgeon device.

6. The barrier hinge assembly as claimed in claim 1, wherein the connecting tube of the turnbuckle assembly is non-circular.

7. A barrier hinge assembly comprising an upper hinge assembly having an upper pintle device having a lower surface; and an upper pintle being formed on and protruding down from the lower surface of the upper pintle device and having an external thread; and an upper gudgeon device being mounted around the upper pintle of the upper pintle device, selectively abutting the lower surface of the upper pintle device and having an upper surface abutting the lower surface of the upper pintle device;

a lower surface; and a through hole being formed through the upper gudgeon device and being mounted rotatably around the upper pintle;

a lower hinge assembly having a lower gudgeon device having an upper surface;

a lower surface; and a through hole being formed through the lower gudgeon device and having an inner wall; and a lower pintle device selectively engaging and holding the lower gudgeon device and having an upper surface facing and selectively abutting the lower surface of the lower gudgeon device; and a lower pintle being formed on and protruding up from the upper surface of the lower pintle device, being mounted rotatably through the through hole of the lower gudgeon device, being aligned with and facing the upper pintle of the upper pintle device and having an external thread; and a turnbuckle assembly being connected rotatably to the upper and the lower pintle devices, selectively squeezing the upper and the lower gudgeon devices between the upper and the lower pintle devices and releasing the upper and the lower pintle devices depending on which direction the turnbuckle assembly is turned and having an upper end attaching to the upper pintle and abutting the lower surface of the upper gudgeon device;

a lower end attaching to the lower pintle and abutting the upper surface of the lower gudgeon device;

an upper threaded hole being formed coaxially in the upper end of the turnbuckle assembly and corresponding and being fastened to the externally threaded upper pintle of the upper pintle device; and a lower hole being formed coaxially in the lower end of the turnbuckle assembly, being threaded and corresponding and being fastened to the externally threaded lower pintle of the lower pintle device.

8. The barrier hinge assembly as claimed in claim 7, wherein the turnbuckle assembly further has a main tube having an upper open end;

a lower open end abutting the upper surface of the lower gudgeon device and being mounted around the lower pintle of the lower pintle device;

a sidewall;

a sleeve being mounted in the upper open end of the main tube; and two elongated slots being formed longitudinally through the sidewall of the main tube near the upper open end diametrically opposite to each other;

a connecting tube having an upper end abutting the lower surface of the upper gudgeon device;

a lower end;

a sidewall;

a coaxial recess being formed in the lower end of the connecting tube and being mounted around the upper open end of the main tube;

two pinholes being formed through the sidewall of the connecting tube diametrically opposite to each other and communicating with the coaxial recess; and a spring being mounted in the coaxial recess and abutting the connecting tube and the sleeve; and a pin extending through the elongated slots of the main tube and the pinholes of the connecting tube;

the upper threaded hole of the turnbuckle assembly is formed coaxially in the upper end of the connecting tube of the turnbuckle assembly; and the threaded lower hole of the turnbuckle assembly is formed coaxially in the lower open end of the main tube of the turnbuckle assembly.

9. The barrier hinge assembly as claimed in claim 8, wherein the connecting tube of the turnbuckle assembly is non-circular.

10. The barrier hinge assembly as claimed in claim 8, wherein the upper pintle device further has a recess being formed in the lower surface of the upper pintle device;

the upper pintle of the upper pintle device is formed concentrically in the recess;

the upper gudgeon device further has a cylindrical protrusion being formed on and protruding up from the upper surface of the upper gudgeon device and being mounted in the recess of the upper pintle device;

the through hole of the upper gudgeon device is formed concentrically with the cylindrical protrusion;

the lower gudgeon device further has a cylindrical protrusion being formed on and protruding down from the lower surface of the lower gudgeon device around the through hole, being tapered and having an outer surface;

the lower pintle device further has a recess being formed in the upper surface of the lower pintle device, being mounted around the cylindrical protrusion of the lower gudgeon device and having an inner sidewall being tapered and selectively holding and pressing against the cylindrical protrusion of the lower gudgeon device; and the lower pintle of the lower pintle device is formed concentrically in the recess of the lower pintle device.

11. The barrier hinge assembly as claimed in claim 10, wherein the lower gudgeon device further has multiple teeth being formed longitudinally on the outer surface of the cylindrical protrusion of the lower gudgeon device; and the inner sidewall of the recess of the lower pintle device further has multiple teeth selectively engaging the teeth of the cylindrical protrusion of the lower gudgeon device.

12. The barrier hinge assembly as claimed in claim 11, wherein the lower gudgeon device further has a guiding groove being formed in the upper surface of the lower gudgeon device and communicating with the through hole;

the inner wall of the through hole of the lower gudgeon device further has an annular shoulder corresponding to the upper surface of the lower gudgeon device; and the lower open end of the main tube of the turnbuckle assembly sliding along the guiding groove into the through hole in the lower gudgeon device and abutting the annular shoulder of the inner wall of the through hole of the lower gudgeon device.

* * * * *